US006045340A

United States Patent [19]

Batchelder et al.

[11] Patent Number: 6,045,340

[45] Date of Patent: Apr. 4, 2000

[54] LOCKING MECHANISM FOR A REMOVABLE LIVE WELL PUMP

[75] Inventors: Scott K. Batchelder, Newburyport; James T. Burrill, Gloucester, both of Mass.

[73] Assignee: Rule Industries, Inc., Gloucester, Mass.

[21] Appl. No.: 08/948,825

[22] Filed: Oct. 10, 1997

[51] Int. Cl.[7] ..... F04B 17/00

[52] U.S. Cl. ..... 417/360; 417/423.14; 417/53

[58] Field of Search ..... 417/360, 53, 423.14

[56] References Cited

U.S. PATENT DOCUMENTS

| | | | |
|---|---|---|---|
| 3,000,543 | 9/1961 | Paul | 222/333 |
| 3,982,856 | 9/1976 | Hehl | 417/360 |
| 4,424,007 | 1/1984 | Mehrens et al. | 417/360 |
| 4,734,016 | 3/1988 | Sailer | 417/360 |
| 4,880,364 | 11/1989 | Berfield et al. | 417/423 |
| 4,904,166 | 2/1990 | Wasemann | 417/360 |
| 5,044,883 | 9/1991 | Neueder | 415/214.1 |
| 5,184,946 | 2/1993 | Sato | 417/423.9 |
| 5,232,341 | 8/1993 | Sheier et al. | 415/201 |
| 5,404,614 | 4/1995 | Stephens | 15/327.2 |
| 5,538,406 | 7/1996 | Siegal et al. | 417/360 |
| 5,833,441 | 11/1998 | Danish et al. | 417/423.14 |

*Primary Examiner*—Charles G. Freay
*Assistant Examiner*—Robert Z. Evora
*Attorney, Agent, or Firm*—Dickstein Shapiro Morin & Oshinsky LLP

[57] ABSTRACT

A removable live well pump including a pump housing having a first housing portion and a second housing portion, a pump intake pipe attached to the second housing portion, a pump assembly attached to the first portion, and a snap fit locking mechanism including a pair of first locking portions located on the first housing portion and a second locking portion located on the second housing portion. The first locking portions are located diametrically opposite each other. The first locking portions are movable between a first locked position, in which the first locking portions engage the second locking portion, and a second unlocked position, in which the first locking portions disengage from the second locking portion. Moving a top portion of each of the first locking portions radially inwardly moves the first locking portions from the first locked position to the second unlocked position.

7 Claims, 3 Drawing Sheets

LOCKING MECHANISM FOR A REMOVABLE LIVE WELL PUMP

BACKGROUND OF THE INVENTION

1. Field of Invention

The present invention relates to pumps. Specifically, the present invention relates to a removable pump for a live well tank used in fishing boats.

2. Description of Related Art

Commercial and recreational fishing boats typically include at least one on-board holding tank that stores bait or caught fish that need to be kept alive until the boat returns to shore. Pumps circulate water through these tanks in order to keep the bait and fish alive. The pump includes an intake pipe generally located below the boat's water line and a discharge pipe running to the tank. A drain tube discharges water overboard to maintain the proper water level in the tank. Conventional live well pumps are attached directly to the boat hull. The pump's intake pipe is inserted in a hole through the hull. The intake pipes are typically manufactured as part of a pump housing component in one integral piece.

The pumps circulate fresh and salt water and they often become clogged with debris and require cleaning. Furthermore, the individual pumps generally require repairs more frequently than the through-hull fitting. Because the intake pipe and pump housing are a single piece, removing the pump for cleaning or repair requires the removal of the intake pipe as well. When both the pump and intake pipes are removed, the hole formed in the boat hull is exposed. Therefore, the boat must be elevated, or removed from the water, or the hole in the boat hull itself must be plugged while the pump is serviced. Plugging the hole in the boat hull is difficult because this hole is often located low in the boat and out of the way, which limits its access and visibility. The prior art procedures for removing the pump are cumbersome and inefficient.

U.S. Pat. No. 5,538,406 discloses a removable cartridge-type pump in which a motor connected to one part of the housing may be removed from another part of the housing. This pump arrangement uses a bayonet or screw connection as well as a locking sear to keep the two parts of the housing together. In order to remove the motor in one embodiment (FIG. 12), the operator must push down a leg 94 of the sear 91 and rotate the motor portion 15 of the pump before removing the motor. In another embodiment (FIGS. 13 and 14), the sear 105 is pulled outward and the motor portion 15 is rotated. In another embodiment (FIG. 15), because the motor portion 15 is formed with external threads which mate with threads 45 on the housing 12, the motor portion 15 must be rotated to be removed. These rotating movements are cumbersome, especially when coupled with moving the sears 91, 105. There is a need in the prior art for a simpler way to remove the motor and pump from a housing connected to the boat transom.

SUMMARY OF THE INVENTION

The disadvantages of the prior art are overcome to a great extent by the present invention, which provides a live well pump that is capable of being removed easily.

Briefly described, the invention comprises a removable live well pump including a pump housing having a first and second housing portion, a pump intake pipe attached to the second housing portion, a pump assembly attached to the first portion, a snap fit locking mechanism including a pair of first locking portions located on the first housing portion and a second locking portion located on the second housing portion, wherein the first locking portions are located diametrically opposite each other. The first locking portions are movable between a first locked position, in which the first locking portions engage the second locking portion, and a second unlocked position, in which the first locking portions disengage from the second locking portion. Moving a top portion of each of the first locking portions radially inwardly moves the first locking portions from the first locked position to the second unlocked position. An O-ring disposed between the first housing portion and the second housing portion provides a seal that prevents water from escaping from the pump housing.

It is an object of the present invention to provide a removable live well pump that is removable from the intake pipe.

It is a further object of the invention to provide a removable live well pump having pivotable snap fit clips.

It is another object of the invention to provide a removable live well pump that is capable of being disengaged with one hand.

Other objects, features and advantages of the present invention will become apparent from the following detailed description and drawings of the preferred embodiments of the present invention.

DESCRIPTION OF PREFERRED EMBODIMENTS

Figure 1:
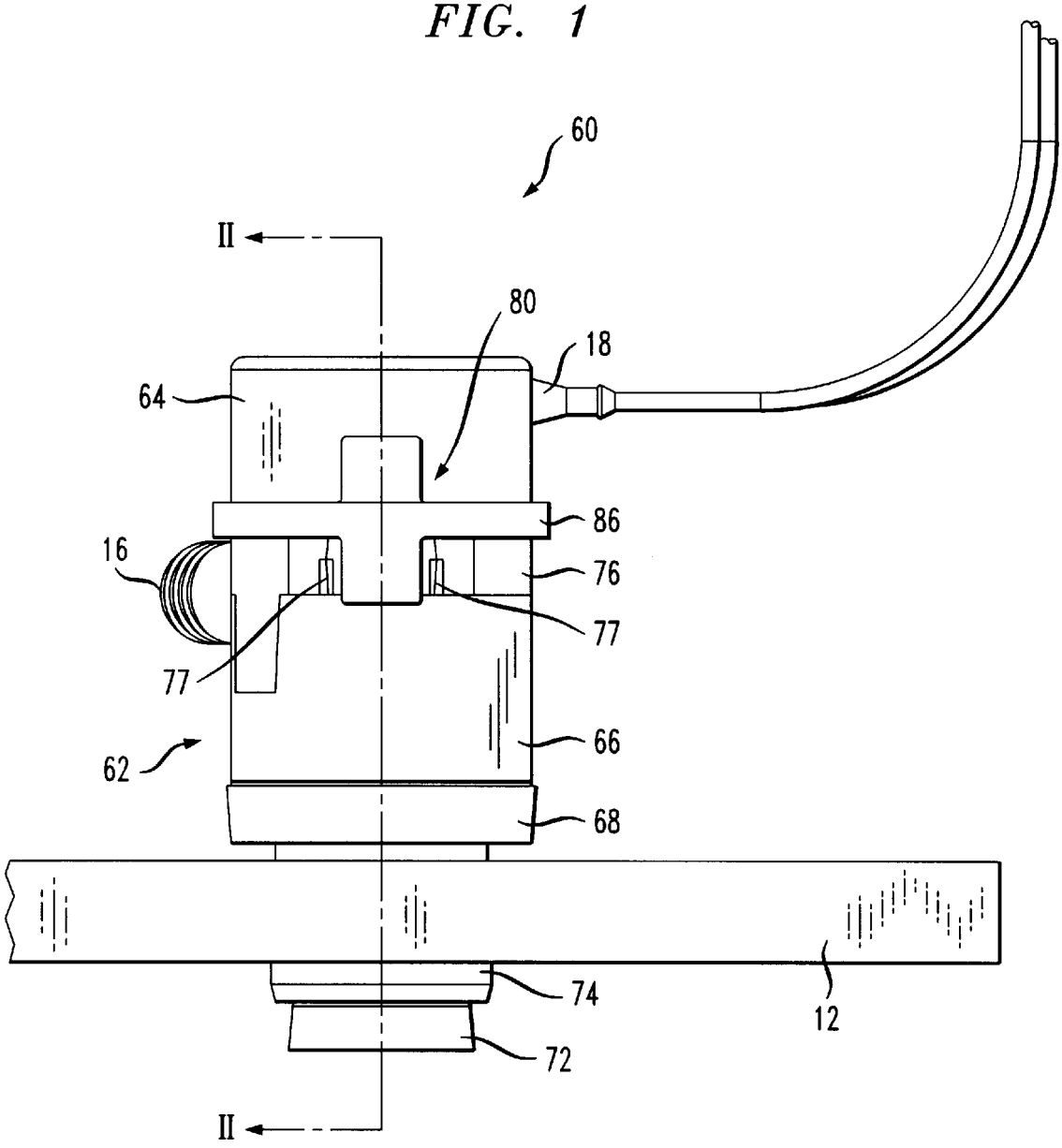
FIG. 1 is a side view of a removable live well pump constructed in accordance with the present invention.
Figure 2:
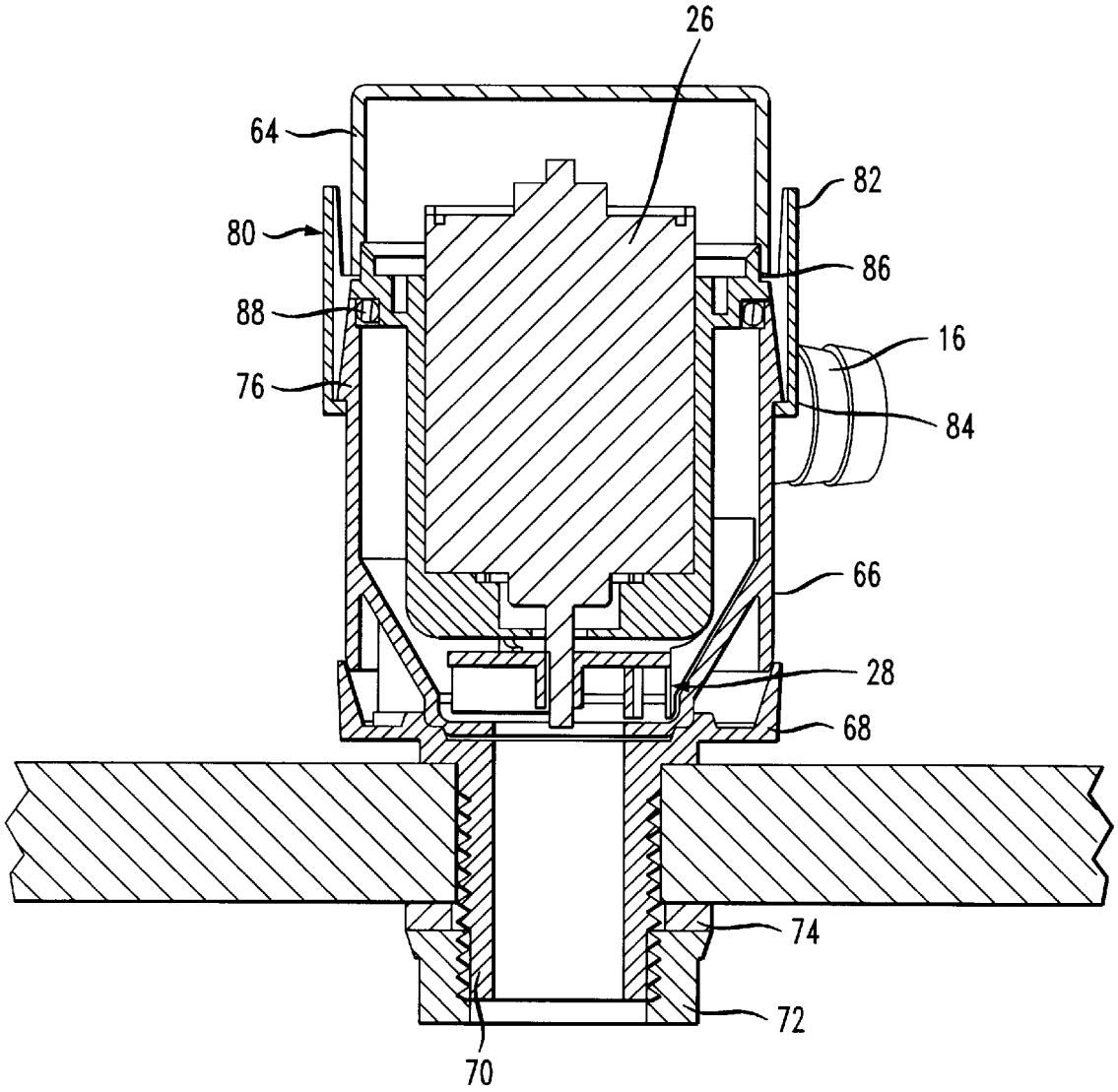
FIG. 2 is a cross-sectional view taken along line II—II of FIG. 1.
Figure 3:
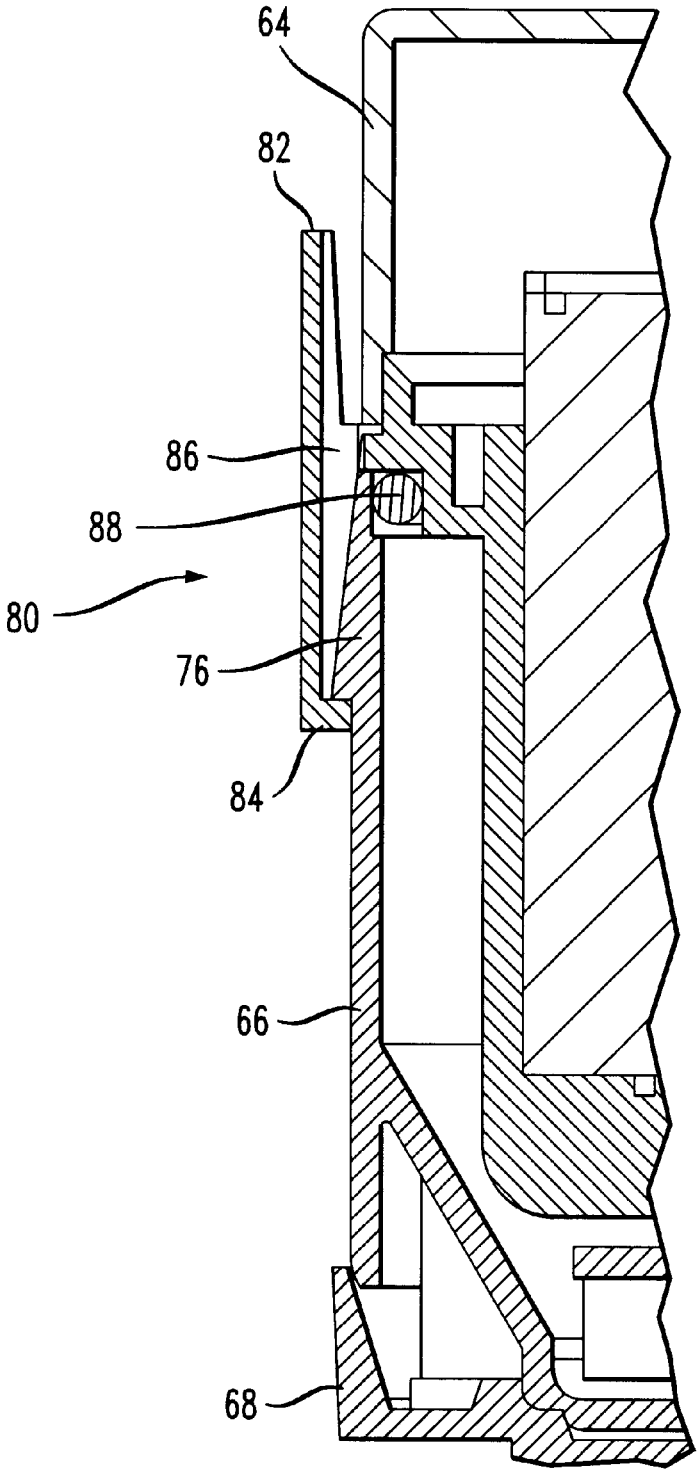
FIG. 3 is a blown up view of FIG. 2 showing the locking mechanism.

Referring now to the drawings, where like parts are designated by like reference numbers throughout, there is shown in FIGS. 1–3 a preferred embodiment of a live well pump 60 constructed according to the present invention. An intake pipe 70 runs through a boat transom 12, which is attached to the boat bottom (not shown). The intake pipe 70 is in communication with a pump housing 62, which in turn is in communication with a flexible discharge pipe 16. The intake pipe 70 is mounted to the boat transom 12 under the boat's water line. The pump housing 62 contains the pump assembly which includes a pump 28 and a motor 26 that powers the pump 28. The pump 28 draws water in through the intake pipe 70 and out through the discharge pipe 16 to the live bait tank (not shown). A drain tube (not shown) allows overflow from the tank to return to the water.

The pump housing 62 includes a housing cap portion 64, a housing main portion 66, and a housing base 68. The housing base 68 is bolted to the housing main portion 66. The intake pipe 70 is integrally formed with the housing base 68 and the discharge pipe 16 is connected to the housing main portion 66. The housing cap portion 64 is removable from the housing main portion 66. When the housing cap portion 64 is removed from the housing main portion 66, the motor 26 and pump 28 remain attached to the housing cap portion 64 and the intake pipe 70 and discharge pipe 16 remain attached to the housing main portion 66. Attached to the housing cap portion 64 is a non-detachable power cord 18.

An O-ring 88 is disposed between the housing cap portion 64 and the housing main portion 66. The O-ring 88 provides a seal that prevents water from escaping from the pump housing 62.

The pump housing 62 includes a snap fit locking mechanism 80. The locking mechanism includes a first locking portion 80 located on the housing cap portion 64 and a second portion 76 located on the housing main portion 66. In a preferred embodiment, the first locking portion 80 is a pair of pivotable clips 80 and the second locking portion is a flange 76 formed on the circumference of the housing main portion 66. In a preferred embodiment, a pair of stops 77 are positioned on the flange 76. The stops 77 prevent rotation of the housing cap portion 64 relative to the housing main portion 66 by engaging one of the clips 80. In an alternative embodiment, a second pair of stops 77 may be place diametrically opposed to the first pair of stops 77 to engage the second of the clips 80.

The clips 80 are located diametrically opposite each other. Each pivotable clip 80 includes a lever portion 82 and a hook portion 84 both connected to the housing cap portion 64 at a pivot point 86. The lever portion 82 and hook portion 84 are integrally formed with the housing cap portion 64. The hook portion 84 is sized to engage the flange 76. The pivot point 86 may be a narrowed plastic portion, such as a live hinge.

To assemble the housing cap portion 64 to the housing main portion 66, the operator depresses the lever portions 82 radially inwardly towards the housing cap portion 64. The clips 80 pivot about the pivot point 86 to cause the hook portion 84 to move radially outwardly. The operator then pushes the housing cap portion 64 towards the housing main portion 66 to depress the O-ring 88. Once the hook portions 84 clear the flange 76, the operator releases the lever portions 82 and the natural resiliency of the clips 80 causes the hook portions 84 to snap radially inwardly and engage the flange 76 to lock the housing cap portion 64 to the housing main portion 66, as shown FIGS. 2 and 3.

To remove the housing cap portion 64, the operator moves the levers portions 82 radially inwardly, which causes the clips 80 to pivot about the pivot point 86 and the hook portions 84 to dislodge from the flange 76. The operator may plug the intake pipe 70 once the housing cap portion 64 is removed. Removing the housing cap portion 64 exposes the pump 28 and motor 26 so that the operator may repair, clean, or replace either component while the discharge pipe 16 and intake pipe 70 remain assembled.

The above description and drawings are only illustrative of preferred embodiments of the present invention, and are not intended to limit the present invention thereto. Any modification of the present invention which comes within the spirit and scope of the following claims is to be considered part of the present invention.

What is claimed as new and desired to be protected by Letters Patent of the United States is:

1. A removable well pump comprising:

a pump housing having a first housing portion and a second housing portion;

a pump intake pipe attached to said second housing portion; and a snap fit locking mechanism including a pair of first locking portions located on said first housing portion and a second locking portion located on said second housing portion;

wherein said first locking portions are located diametrically opposite each other;

wherein said first locking portions are movable between a first locked position in which said first locking portions engage said second locking portion, and a second unlocked position in which said first locking portions disengage from said second locking portion;

wherein a lever portion of each of said first locking portions has a first end and a second end; and wherein moving said first end of said lever portion radially inwardly moves said second end of said lever portion radially outwardly and thereby moves the first locking portions from said first locked position to said second unlocked position.

2. The removable live well pump of claim 1, further comprising:

an O-ring disposed between said first housing portion and said second housing portion providing a seal that prevents water from escaping from said pump housing.

3. The removable live well pump of claim 1, wherein:

each of said pair of said first locking portions includes a pivotable clip having said lever portion and a hook portion;

said second locking portion includes a flange formed circumferentially around said second housing portion and a recess formed between said flange and said second housing portion sized to receive said hooks; and said hooks being lodged with said recesses when said first locking portions are in said locked position.

4. The removable live well pump of claim 3, wherein said pivotable clips are arranged to be moved from said first locked position to said second unlocked position with one hand.

5. A method of removing a live well pump assembly from a sealed pump housing comprising the steps of:

moving a first end of a lever portion of a pair of diametrically opposed clips radially inwardly with one hand to disengage a hook portion of a second end of said lever portion of said clip from a recess formed proximate said pump housing; and lifting said pump assembly attached to a first portion of said pump housing from a second portion of said housing.

6. A removable well pump comprising:

a pump housing having a first housing portion and a second housing portion;

a snap fit lever locking mechanism including a pair of first locking portions located on said first housing portion and a second locking portion located on said second housing portion;

wherein said first locking portions are located diametrically opposite each other; and wherein said first housing portion and second housing portion are connected with said snap fit lever locking mechanism to create a sealed pump housing.

7. A removable well pump as in claim 6, wherein said snap fit lever locking mechanism is external to said housing.

* * * * *